US010264340B1

(12) United States Patent
Hsu

(10) Patent No.: US 10,264,340 B1
(45) Date of Patent: Apr. 16, 2019

(54) MODULARIZED TRACK LIGHTING ASSEMBLY

(71) Applicant: Dong Guan Bright Yinhuey Lighting Co., Ltd. China, Guang Dong (CN)

(72) Inventor: Kevin Hsu, Taichung (TW)

(73) Assignee: Dong Guan Bright Yinhuey Lighting Co., Ltd. China, Guang Dong (CN)

( * ) Notice: Subject to any disclaimer, the term of this patent is extended or adjusted under 35 U.S.C. 154(b) by 0 days.

(21) Appl. No.: 15/895,009

(22) Filed: Feb. 13, 2018

(51) Int. Cl.

| | |
|---|---|
| ***H04R 1/02*** | (2006.01) |
| ***F21V 23/06*** | (2006.01) |
| ***F21V 21/005*** | (2006.01) |
| ***F21V 21/30*** | (2006.01) |
| ***F21V 23/00*** | (2015.01) |
| ***F21V 21/34*** | (2006.01) |
| ***F21V 17/12*** | (2006.01) |

(52) U.S. Cl.
CPC ..... *H04R 1/028* (2013.01); *F21V 17/12* (2013.01); *F21V 21/005* (2013.01); *F21V 21/30* (2013.01); *F21V 21/34* (2013.01); *F21V 23/003* (2013.01); *F21V 23/06* (2013.01); *H04R 2420/09* (2013.01)

(58) Field of Classification Search
CPC ..... H04R 1/028; F21V 17/12
See application file for complete search history.

(56) References Cited

U.S. PATENT DOCUMENTS

| | | | | |
|---|---|---|---|---|
| 6,497,586 | B1 * | 12/2002 | Wilson | H01R 13/73 362/383 |
| 7,854,527 | B2 * | 12/2010 | Anderson | F21V 3/00 362/133 |
| 2009/0190345 | A1 * | 7/2009 | Belliveau | H05B 33/0863 362/231 |
| 2014/0119019 | A1 * | 5/2014 | Hsu | F21V 29/006 362/269 |
| 2015/0330778 | A1 * | 11/2015 | Sinha | G01B 21/00 702/150 |

* cited by examiner

*Primary Examiner* — Anne M Hines
(74) *Attorney, Agent, or Firm* — Alan D. Kamrath; Kamrath IP Lawfirm, P.A.

(57) ABSTRACT

A modularized track lighting assembly includes a track unit, and a lighting unit or sound module. The track unit includes a housing, a first connecting terminal, a second connecting terminal, a circuit board and a multifunctional operator. The multifunctional operator is rotatable on the housing to change the output state of the circuit board during rotation. Thus, the track unit cooperates with either the lighting unit or the sound module by connection of the multifunctional operator to have either an illuminating function or an audio playing function, so that the modularized track lighting assembly has illuminating and audio playing functions.

6 Claims, 4 Drawing Sheets

MODULARIZED TRACK LIGHTING ASSEMBLY

BACKGROUND OF THE INVENTION

1. Field of the Invention

The present invention relates to a lighting apparatus and, more particularly, to a modularized track lighting assembly.

2. Description of the Related Art

A conventional track lighting comprises a bar frame attached to an object, such as a track or the like, a transformer mounted on the bar frame, and a spot pivotally mounted on the transformer. However, the conventional track lighting only provides an illuminating function and cannot be adapted to have an audio playing function, thereby limiting the versatility of the conventional track lighting.

BRIEF SUMMARY OF THE INVENTION

The primary objective of the present invention is to provide a modularized track lighting assembly that integrates illuminating and audio playing functions.

In accordance with the present invention, there is provided a modularized track lighting assembly comprising a track unit, and a lighting unit or sound module. The track unit cooperates with either the lighting unit or the sound module to have either an illuminating function or an audio playing function. The track unit includes a housing, a first connecting terminal, a second connecting terminal, a circuit board and a multifunctional operator. The multifunctional operator is rotatably mounted on the housing and electrically connected with the circuit board. The multifunctional operator is rotatable on the housing to change an output state of the circuit board during rotation. The first connecting terminal is mounted in the housing and functions as an AC power supply terminal. The second connecting terminal is mounted in the housing and electrically connected with the circuit board. The lighting unit includes an illuminating device, a third connecting terminal a connected with the illuminating device, and a fourth connecting terminal connected with the illuminating device. When the lighting unit is connected with the track unit, the third connecting terminal is connected with the first connecting terminal, and the fourth connecting terminal is connected with the second connecting terminal. An external power source provides an electric power which is delivered through the first connecting terminal and the third connecting terminal into the illuminating device, to energize the lighting unit. The multifunctional operator functions as a color temperature regulator of the lighting unit. The sound module includes an audio device, a fifth connecting terminal connected with the audio device, and a sixth connecting terminal connected with the audio device. When the sound module is connected with the track unit, the fifth connecting terminal is connected with the first connecting terminal, and the sixth connecting terminal is connected with the second connecting terminal. The electric power of the external power source is delivered through the first connecting terminal and the fifth connecting terminal into the audio device, to energize the sound module. The multifunctional operator functions as a sound regulator of the sound module.

Preferably, the lighting unit is detachably mounted on the track unit, and the sound module is detachably mounted on the track unit.

Preferably, the housing of the track unit has an interior provided with an internal thread, and the illuminating device of the lighting unit is provided with an external thread screwed into the internal thread of the track unit.

Preferably, the housing of the track unit has an interior provided with an internal thread, and the audio device of the sound module is provided with an external thread screwed into the internal thread of the track unit.

Preferably, the audio device of the sound module is provided with a guide slot extending longitudinally and a locking groove extending transversely and connected to the guide slot, and the housing of the track unit is provided with a locking piece extending through the guide slot into the locking groove of the sound module.

Preferably, the illuminating device of the lighting unit is provided with a guide slot extending longitudinally and a locking groove extending transversely and connected to the guide slot, and the housing of the track unit is provided with a locking piece extending through the guide slot into the locking groove of the lighting unit.

According to the primary advantage of the present invention, the track unit cooperates with the lighting unit or the sound module by connection of the multifunctional operator to switch an illuminating function and an audio playing function, so that the modularized track lighting assembly has illuminating and audio playing functions.

According to another advantage of the present invention, the multifunctional operator regulates the working condition of the lighting unit or the sound module that is mounted on the track unit.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
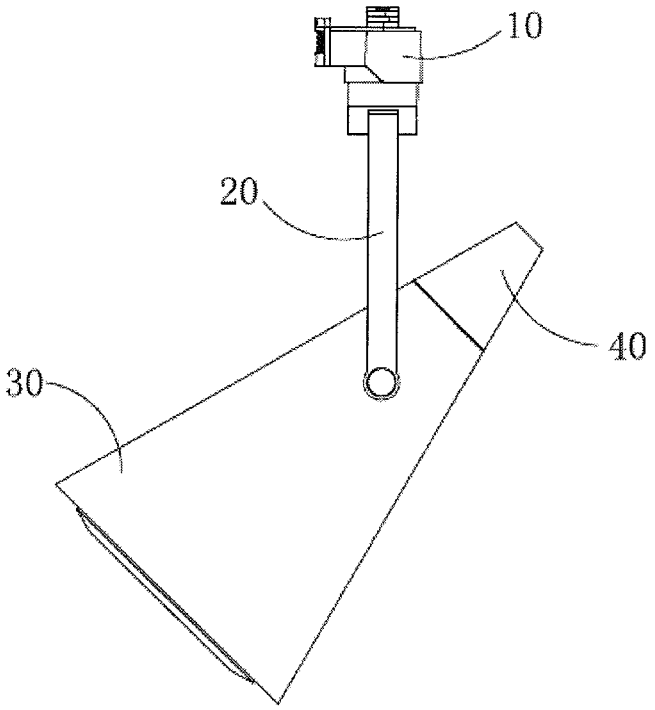
FIG. 1 is a side view of a track unit in accordance with the preferred embodiment of the present invention.
Figure 2:
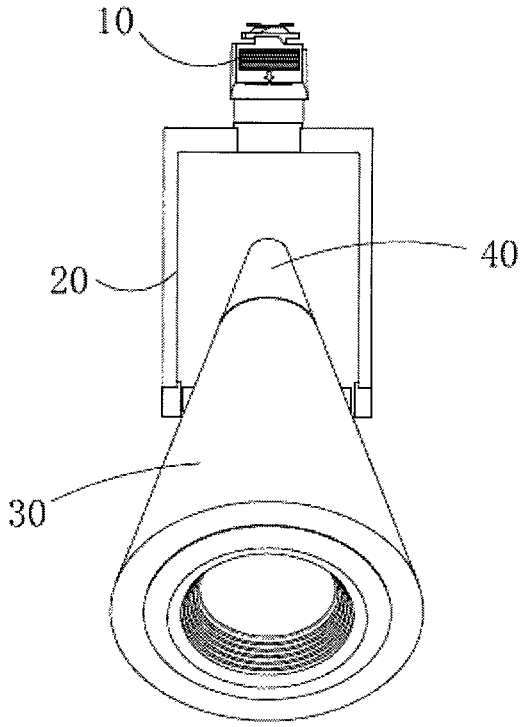
FIG. 2 is a perspective view of the track unit in accordance with the preferred embodiment of the present invention.
Figure 3:
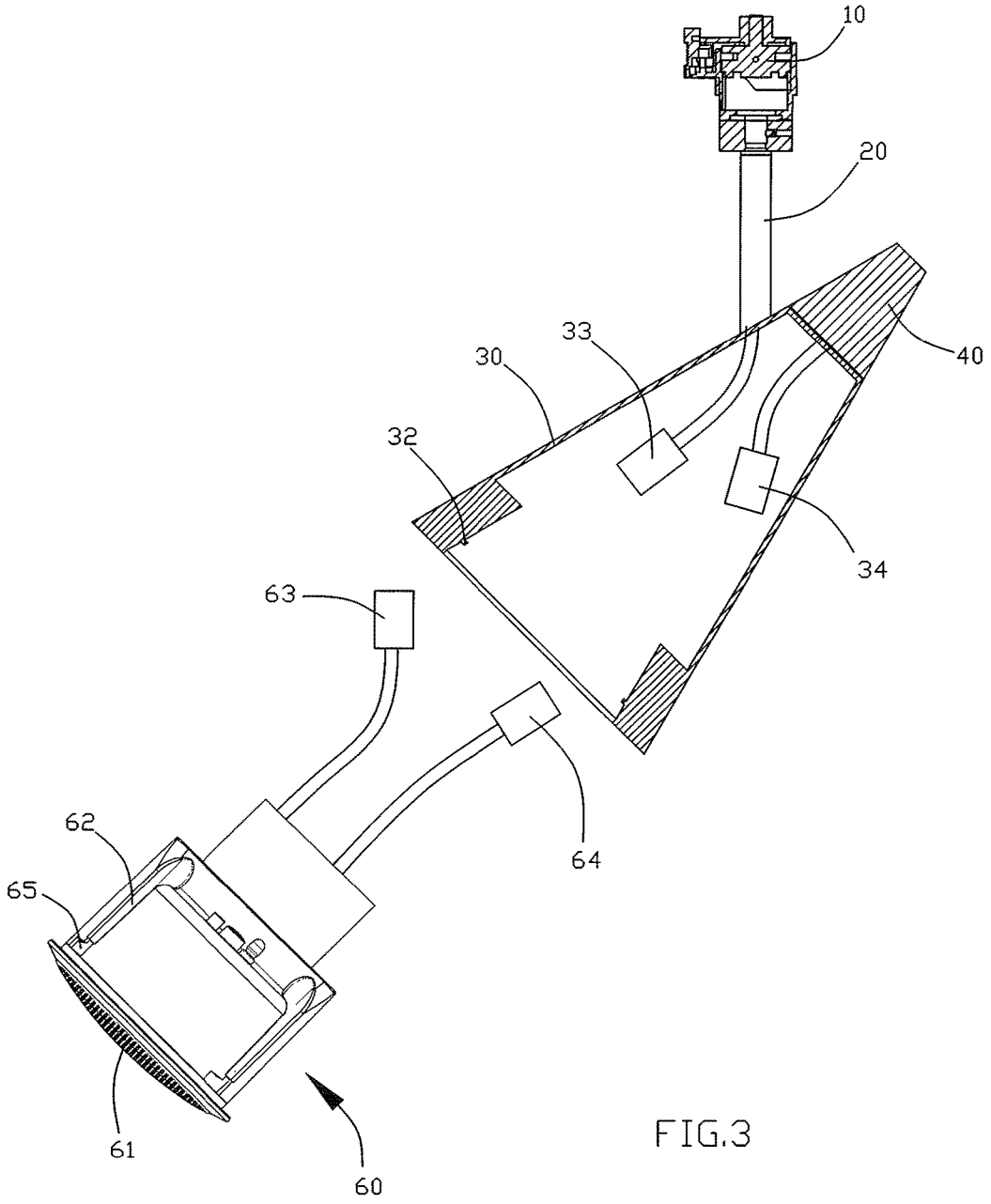
FIG. 3 is a cross-sectional view showing connection of the track unit with a sound module.
Figure 4:
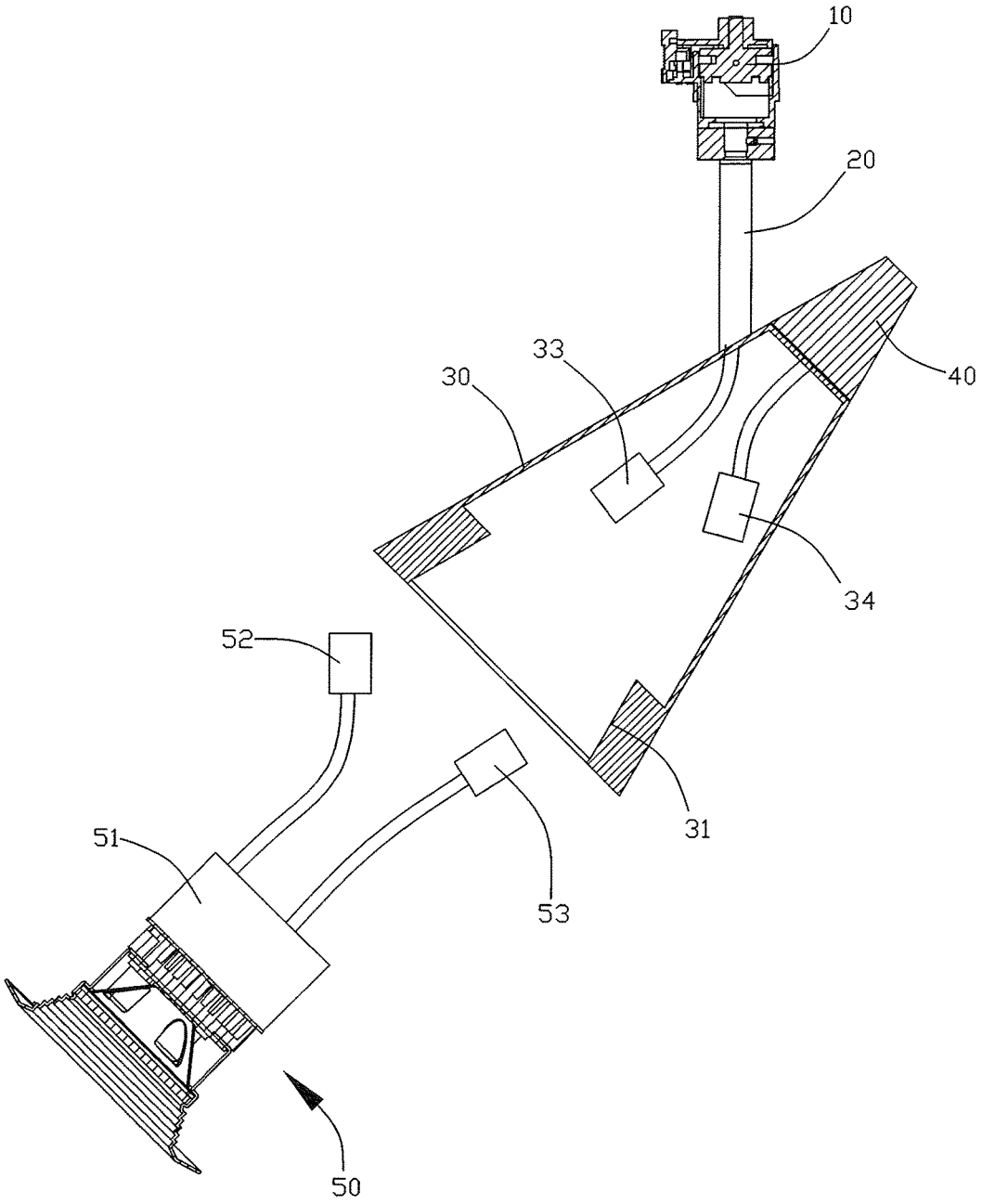
FIG. 4 is a cross-sectional view showing connection of the track unit with a lighting unit.

Referring to FIGS. 1-4, a modularized track lighting assembly in accordance with the preferred embodiment of the present invention comprises a track unit, and a lighting unit 50 or sound module 60. The track unit cooperates with either the lighting unit 50 or the sound module 60 to have either an illuminating function or an audio playing function The track unit includes a power supply seat 10, a connecting frame 20, a housing 30, a first connecting terminal 33, a second connecting terminal 34, a circuit board and a multifunctional operator 40. The connecting frame 20 is mounted on the power supply seat 10. The housing 30 is pivotally connected with the connecting frame 20 and is rotatable relative to the connecting frame 20 to perform an angle adjustment. The housing 30 has a conic shape. The multifunctional operator 40 is rotatably mounted on the housing 30 and electrically connected with the circuit board.

The multifunctional operator 40 has a conic shape corresponding to that of the housing 30. The multifunctional operator 40 is rotatable on the housing 30 to change an output state of the circuit board during rotation. The first connecting terminal 33 is mounted in the housing 30 and has a conducting wire extending through the connecting frame 20 and connected with a contact of the power supply seat 10. Thus, the first connecting terminal 33 functions as an AC power supply terminal. The second connecting terminal 34 is mounted in the housing 30 and electrically connected with the circuit board.

The lighting unit 50 includes an illuminating device 51, a third connecting terminal 52 connected with the illuminating device 51, and a fourth connecting terminal 53 connected with the illuminating device 51. When the lighting unit 50 is connected with the track unit, the third connecting terminal 52 is connected with the first connecting terminal 33, and the fourth connecting terminal 53 is connected with the second connecting terminal 34. An external power source provides an electric power which is delivered through the first connecting terminal 33 and the third connecting terminal 52 into the illuminating device 51, so as to energize the lighting unit 50. The multifunctional operator 40 functions as a color temperature regulator, so that the user can regulate the color temperature of the illuminating device 51 according to the practical requirement.

The sound module 60 includes an audio device 61, a fifth connecting terminal 63 connected with the audio device 61, and a sixth connecting terminal 64 connected with the audio device 61. When the sound module 60 is connected with the track unit, the fifth connecting terminal 63 is connected with the first connecting terminal 33, and the sixth connecting terminal 64 is connected with the second connecting terminal 34. The electric power of the external power source is delivered through the first connecting terminal 33 and the fifth connecting terminal 63 into the audio device 61, so as to energize the sound module 60. The multifunctional operator 40 functions as a sound regulator, so that the user can regulate the working condition of the audio device 61 according to the practical requirement.

In the preferred embodiment of the present invention, the lighting unit 50 is detachably mounted on the track unit, and the sound module 60 is detachably mounted on the track unit.

In the preferred embodiment of the present invention, the housing 30 of the track unit has an interior provided with an internal thread 31, and the illuminating device 51 of the lighting unit 50 is provided with an external thread screwed into the internal thread 31 of the track unit. Similarly, the audio device 61 of the sound module 60 is provided with an external thread screwed into the internal thread 31 of the track unit.

In the preferred embodiment of the present invention, the housing 30 of the track unit is provided with a locking piece 32. The audio device 61 of the sound module 60 is provided with a guide slot 62 extending longitudinally and a locking groove 65 extending transversely and connected to the guide slot 62, and the locking piece 32 of the track unit extends through the guide slot 62 into the locking groove 65 of the sound module 60. Similarly, the illuminating device 51 of the lighting unit 50 is provided with a guide slot extending longitudinally and a locking groove extending transversely and connected to the guide slot, and the locking piece 32 of the track unit extends through the guide slot into the locking groove of the lighting unit 50.

Accordingly, the track unit cooperates with the lighting unit 50 or the sound module 60 by connection of the multifunctional operator 40 to switch an illuminating function and an audio playing function, so that the modularized track lighting assembly has illuminating and audio playing functions. In addition, the multifunctional operator 40 regulates the working condition of the lighting unit 50 or the sound module 60 that is mounted on the track unit.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A modularized track lighting assembly comprising:

a track unit, and a lighting unit or sound module;

wherein:

the track unit cooperates with either the lighting unit or the sound module to have either an illuminating function or an audio playing function;

the track unit includes a housing, a first connecting terminal, a second connecting terminal, a circuit board and a multifunctional operator;

the multifunctional operator is rotatably mounted on the housing and electrically connected with the circuit board;

the multifunctional operator is rotatable on the housing to change an output state of the circuit board during rotation;

the first connecting terminal is mounted in the housing and functions as an AC power supply terminal;

the second connecting terminal is mounted in the housing and electrically connected with the circuit board;

the lighting unit includes an illuminating device, a third connecting terminal connected with the illuminating device, and a fourth connecting terminal connected with the illuminating device;

when the lighting unit is connected with the track unit, the third connecting terminal is connected with the first connecting terminal, and the fourth connecting terminal is connected with the second connecting terminal;

an external power source provides an electric power which is delivered through the first connecting terminal and the third connecting terminal into the illuminating device, to energize the lighting unit;

the multifunctional operator functions as a color temperature regulator of the lighting unit;

the sound module includes an audio device, a fifth connecting terminal connected with the audio device, and a sixth connecting terminal connected with the audio device;

when the sound module is connected with the track unit, the fifth connecting terminal is connected with the first connecting terminal, and the sixth connecting terminal is connected with the second connecting terminal;

the electric power of the external power source is delivered through the first connecting terminal and the fifth connecting terminal into the audio device, to energize the sound module; and the multifunctional operator functions as a sound regulator of the sound module.

2. The modularized track lighting assembly of claim 1, wherein the lighting unit is detachably mounted on the track unit, and the sound module is detachably mounted on the track unit.

3. The modularized track lighting assembly of claim 1, wherein the housing of the track unit has an interior provided with an internal thread, and the illuminating device of the lighting unit is provided with an external thread screwed into the internal thread of the track unit.

4. The modularized track lighting assembly of claim 1, wherein the housing of the track unit has an interior provided with an internal thread, and the audio device of the sound module is provided with an external thread screwed into the internal thread of the track unit.

5. The modularized track lighting assembly of claim 1, wherein the audio device of the sound module is provided with a guide slot extending longitudinally and a locking groove extending transversely and connected to the guide slot, and the housing of the track unit is provided with a locking piece extending through the guide slot into the locking groove of the sound module.

6. The modularized track lighting assembly of claim 1, wherein the illuminating device of the lighting unit is provided with a guide slot extending longitudinally and a locking groove extending transversely and connected to the guide slot, and the housing of the track unit is provided with a locking piece extending through the guide slot into the locking groove of the lighting unit.

* * * * *